United States Patent [19]

Codorniu

[11] 4,071,050

[45] Jan. 31, 1978

[54] DOUBLE-LAYER FORMING FABRIC

[75] Inventor: Francisco Lorente Codorniu, Halmstad, Sweden

[73] Assignee: Nordiska Maskinfilt Aktiebolaget, Halmstad, Sweden

[21] Appl. No.: 804,950

[22] Filed: June 9, 1977

Related U.S. Application Data

[63] Continuation of Ser. No. 379,322, July 16, 1973, abandoned.

[30] Foreign Application Priority Data

Sept. 1, 1972 Sweden ..... 11347/72

[51] Int. Cl.[2] ..... D03D 15/00

[52] U.S. Cl. ..... 139/383 R; 139/413; 139/425 A

[58] Field of Search ..... 139/383, 383 A, 408, 139/409, 410, 411, 413, 420 R, 425 R, 425 A, 426 R; 162/348, 356, DIG. 1

[56] References Cited

U.S. PATENT DOCUMENTS

| | | | |
|---|---|---|---|
| 3,143,150 | 8/1964 | Buchanan | 139/425 A |
| 3,296,062 | 1/1967 | Truslow | 139/426 |
| 3,573,164 | 3/1971 | Friedberg et al. | 139/425 |
| 4,041,989 | 8/1977 | Johansson et al. | 139/425 A |

*Primary Examiner*—Henry S. Jaudon

[57] ABSTRACT

A double-layer forming wire for paper-making, cellulose and similar machines, said wire being particularly arranged to prevent marking on the material to be formed. The wire comprises two layers of weft yarns interconnected by warp threads, the weft layer intended to face the material to be formed (top layer) and said warp threads being essentially tangents to the plane of the wire intended to face said material. In accordance with a special arrangement the warp threads also bind separately with the layer of weft threads (top layer) intended to face said material. The invention likewise concerns a method of producing a forming wire of the above structure.

15 Claims, 7 Drawing Figures

DOUBLE-LAYER FORMING FABRIC

This is a continuation of application Ser. No. 379,322, filed July 16, 1973, now abandoned.

BACKGROUND OF THE INVENTION

In paper-making and cellulose machines and machines for similar purposes single-layer wires woven from metal wire or synthetic fibre threads of monofilaments or multifilaments are used for forming the sheets. On account of their poor wear resistance, metal wires are often replaced by wires made from synthetic fibre threads, so-called plastic fabrics. These plastic fabrics hitherto have been made almost exclusively as single-layer fabrics. However, fabrics of this type suffer from the disadvantage of being a great deal more stretchable than metal wires of comparative thickness gauge. For a long time the use of plastic fabrics therefore has been limited to the coarser wire assortment and to narrow and slow-moving paper-making machines. Although considerable improvement has been made during the last years, single-layer plastic fabrics have met with little success as concerns for instance broad and speedy newsprint paper machines and so-called tissue paper machines. Also in the case of broad liner, kraft and sack paper machines several attempts to use plastic fabrics have failed, although coarse and thus more stable fabrics were used.

So called double-layer plastic fabrics consisting of two layers of one yarn system and a second yarn system interconnecting the first two layers are, on account of their improved stability, more likely to succeed in all types of paper machines. This fact has also been documented by a large number of test runs. A double-layer fabric has for instance been in operation in a broad liner machine during six months as compared with eight to ten days for a metal wire. The problem met with in this kind of double-layer fabrics has hitherto been their tendency to mark the paper web to a larger extent than do single-layer ones. The reason for the increased marking tendency is that the two parallel layers of weft threads, and particularly the layer closest to the material to be formed, extend substantially straight and in plane inside the fabric, whereas the warp threads extend in a curved shape, tangent to the two outer planes. In the corresponding case in a single-layer cloth this disadvantage may easily be remedied by applying a load to the warp threads whereby their curvature is straightened while at the same time the weft threads become crimped. At a certain border value the wave crests are tangent to a common plane. If the single-layer fabric is fixed in this position, the web will contact both thread systems during sheet formation and the risk for marking decreases.

The geometric construction hitherto applied in the double-layer fabric has made a corresponding operation impossible, any straightening of the warp threads having instead resulted in the weft threads penetrating deeper down towards the centre of the fabric.

The present invention concerns a forming fabric for paper-making cellulose and similar machines, said fabric being made from a synthetic fibre material and comprising two layers of weft yarns and warp threads interconnecting said two layers. The purpose of the invention is to remedy the marking problems hitherto experienced in prior-art double-layer forming fabrics.

SUMMARY OF THE PRESENT INVENTION

The invention is characterised in that the layer of weft yarns intended in position of use of the fabric to face the material to be formed, and the warp threads interconnecting the two weft layers are essentially tangents to the plane of the fabric (outer plane) facing said material. This is achieved in that each warp thread, in addition to interconnecting the two weft layers, also binds separately with the layer of weft threads which in position of use of the fabric faces the material to be formed. Because the warp threads in this separate binding — which may be of two-shaft type — partly binds only with the above-mentioned layer of weft threads, the tension in these threads which tension is occasioned either by the ordinary warp tension during the weaving proper or applied through separate stretching of the cloth when the latter is completed, will bring about an increase of the wave formation of these weft yarns in the direction towards the cloth surface plane whereas at the same time the wave-shaped warp threads will be straightened. In a certain position, the said layer of weft threads as well as the warp threads interconnecting the layers are tangents to the same plane, which plane also is the outer plane of the fabric.

BRIEF DESCRIPTION OF THE DRAWINGS

The invention will be described more in detail in the following with reference to the accompanying, partly diagrammatical drawings, wherein, FIG. 2 illustrates likewise as an example a cross section through a double-layer fabric in accordance with the invention in unstretched condition, whereas

DETAILED DESCRIPTION OF A PREFERRED EMBODIMENT

Figure 1:
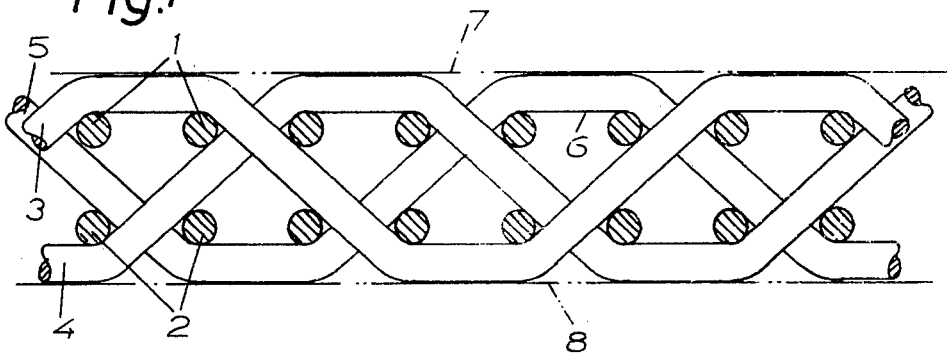
FIG. 1 illustrates as an example a cross section through an ordinary type of a double-layer forming fabric cloth.

The ordinary type of a double-layer forming fabric, like double layer fabrics for press- and dryer sections, consist of two layers of weft threads 1, 2 — one layer 1 facing the material to be formed — and warp threads 3, 4, and 5 interconnecting the two weft layers. The two layers 1, 2 of weft threads form pairs with the threads of each pair positioned essentially on top of one another. The first warp thead (FIG. 1) binds over the first two pairs, between pair number three and beneath pairs number four and five and between pair number six before the pattern is repeated. The warp threads 4, 5 shown bind in the same manner but in a different order and in addition, the pattern includes a further three warp threads which are not illustrated, before the binding procedure for the first warp thread 3 is again repeated. The pattern which may be characterised by its binding over two pairs of weft threads and beneath two pairs of weft threads lends itself to a number of variations wherein each warp thread may bind over and beneath, respectively, one or several pairs of weft threads. The type of double-layer forming fabric illustrated in FIG. 1 has one weft layer of straight yarns extending in a plane 6 located within the fabric whereas the warp threads extend in wave-form and are tangents to the two outer planes 7 and 8. The geometrical composition of the fabric is such that no matter how much the warp threads 3, 4, and 5 are stretched during weaving or separately after the weaving, the weft layer 1 cannot assume a position in the same plane as the warp threads 3, 4, and 5.

Figure 2:
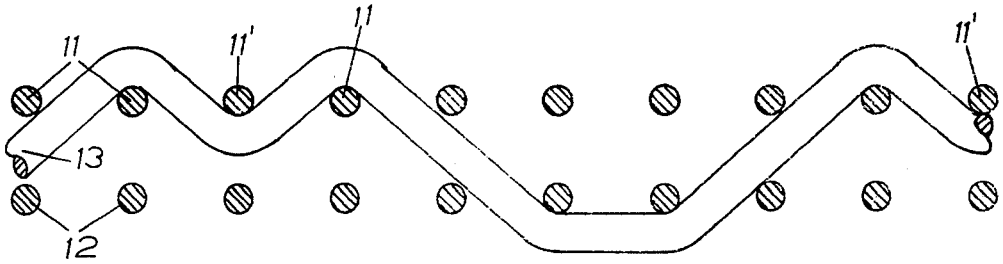
Figure 7:
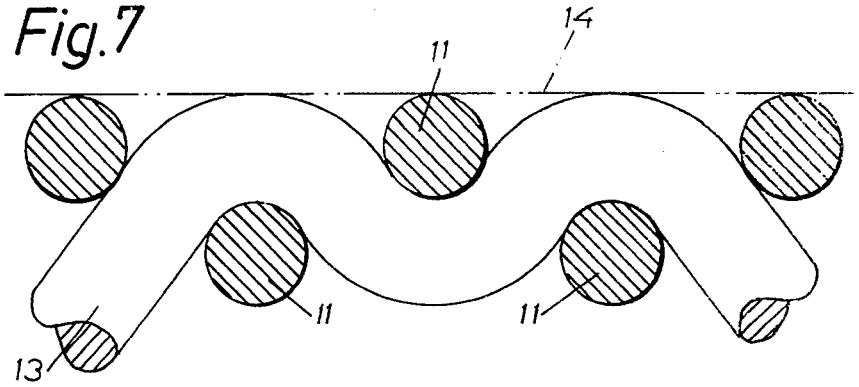
FIG. 7 shows on an enlarged scale a portion of the top layer of the fabric illustrated in FIG. 2, after stretching of the fabric.

If instead, as illustrated in FIG. 2, the warp threads, in addition to interconnecting the two weft layers also binds separately with the layer of weft threads which, in position of use of the fabric, faces the material to be formed, a fabric in accordance with the invention is produced. The structure still consists of two layers of weft threads 11, 12, one layer 11 facing the material to be formed, and of warp threads interconnecting the layers. In FIG. 2, only one warp thread 13 is illustrated. The warp thread illustrated weaves between the first pair of weft threads 11, 12, above pair number 2, between pair number 3, over pair number 4, between pair number 5, beneath pairs number 6 and number 7 before the procedure is repeated. The structure illustrated comprises a further six warp threads, not illustrated, before the procedure for warp thread 13 is repeated. The warp thread 13 together with the other six warp threads interconnect the two layers of weft threads 11, 12 but in addition each warp thread also binds separately with the layer of weft threads which in position of use of the fabric faces the material to be formed. In FIG. 2, this is evident from the manner in which the binding of warp thread 13 is executed between the first and fifth pairs of weft threads 11, 12. Owing to this separate binding, any stretching of the warp thread 13 has an effect on the weft thread 11' in such a way that the latter is lifted and becomes tangent to the same plane 14 (FIG. 7) as warp thread 13, which plane also forms the outer plane of the fabric. In the same manner as the warp thread 13 affects weft thread 11', the other six warp threads in the pattern have an effect on each one of the six intermediate weft threads 11. FIG. 2 illustrates the positions of threads 11, 12, 13, before stretching but in fact this is only an imaginary structure as already during the weaving the warp threads 11 are influenced by the warp tension to such a high degree that their position is practically the one illustrated in FIG. 7.

The structure illustrated and described — wherein the separate binding between the warp threads 13 and the upper layer of weft threads 11 is a two-shaft binding — is to be regarded as an example only and thus the length of this two-shaft binding may vary and may also be replaced by another pattern, such as for instance three-shaft or four-shaft. Some weave patterns of this kind are illustrated in FIGS. 3 – 6.

Figure 3:
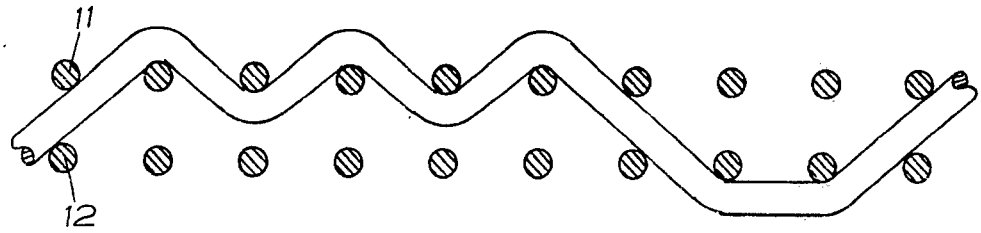
FIGS. 3 - 6 illustrate in similar cross-sectional views various fabrics in accordance with different weaving patterns.

In accordance with FIG. 3 the warp thread weaves between the first pair of weft threads 11, 12, above pair number 2, between pair number 3, over pair number 4, between pair number 5, over pair number 6, between pair number 7 and beneath pairs number 8 and 9 before repeat of pattern.

Figure 4:
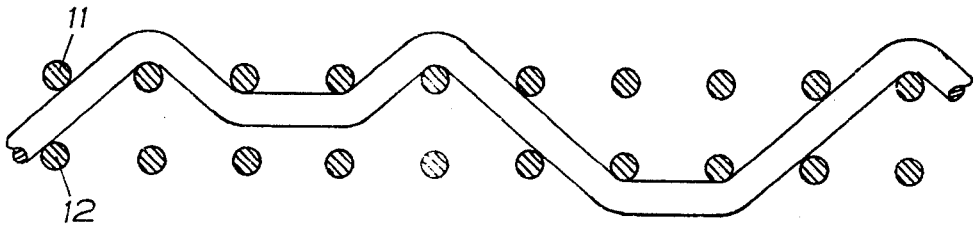

In accordance with FIG. 4, the warp thread weaves between the first pair of weft threads 11, 12, above pair number 2, between pairs number 3 and number 4, above pair number 5, between pair number 6 and beneath pairs number 7 and number 8 before repeat of pattern.

Figure 5:
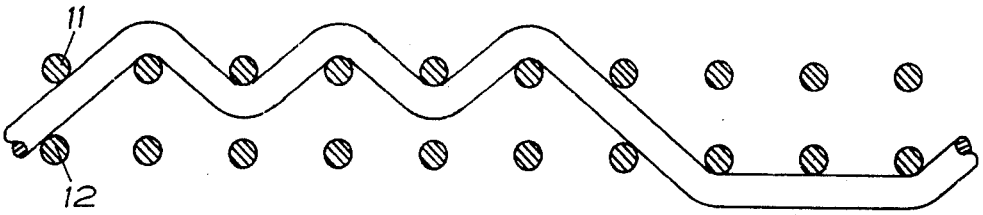

In accordance with FIG. 5, the warp thread weaves between the first pair of weft threads 11, 12, above pair number 2, between pair number 3, over pair number 4, between pair number 5, over pair number 6, between pair number 7 and beneath pairs number 8, number 9, and number 10 before repeat of pattern.

Figure 6:
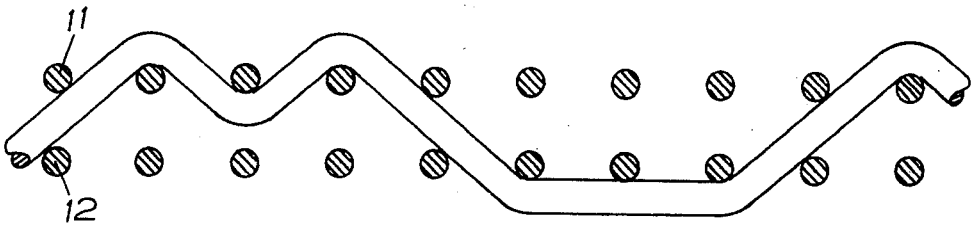

In accordance with FIG. 6, finally, the warp threads weaves between the first pair of weft threads 11, 12, over pair number 2, between pair number 3, over pair number 4, between pair number 5 and underneath pairs number 6, number 7, and number 8 before repeat of pattern.

What I claim is:

1. An improved forming fabric for paper-making, cellulose or similar machines, said fabric comprising two layers of synthetic weft threads and synthetic warp threads interconnecting said weft threads, the improvement comprising an upper one of said layers of weft threads arranged to face the material to be formed during position of use of said fabric, said upper layer as well as said warp threads interconnecting said weft layers being essentially tangents to the fabric plane intended to face said material, and each of said warp threads passing over at least one weft thread, under at least one following weft thread and over at least one thereon following weft thread of said upper weft layer before running down to interconnect the lower weft layer with the upper weft layer.

2. An improved forming wire as claimed in claim 1, the improvement comprising synthetic monofilament yarns forming the yarns of said two layers of weft threads as well as said warp threads interconnecting said layers.

3. An improved forming wire as claimed in claim 1, the improvement comprising synthetic multifilament yarns forming the yarns of said two layers of weft threads as well as said warp threads interconnecting said layers.

4. An improved forming wire as claimed in claim 1, the improvement comprising monofilament yarns forming the yarns of said two layers of weft threads and multifilament yarns forming the yarns of said warp threads interconnecting said layers.

5. An improved forming wire as claimed in claim 1, the improvement comprising multifilament yarns forming the yarns of said two layers of weft threads and monofilament yarns forming the yarns of said warp threads interconnecting said layers.

6. An improved forming fabric for paper-making, cellulose or similar machines, said fabric comprising two layers of synthetic weft threads and synthetic warp threads interconnecting said weft layers, the improvement comprising a first one of said layers of weft threads arranged to face the material to be formed during position of use of said fabric, said first layer as well as said warp threads interconnecting said weft layers being essentially tangents to the fabric plane intended to face said material said two layersof weft thread being made to form a pair to position said threads of each said pair essentially one on top of the other, each said warp thread binding in sequence between a first pair of weft threads, over a second pair of weft threads, between a third pair of weft threads, above a fourth pair of weft threads, between a fifth pair of weft threads, and beneath a sixth pair and a seventh pair of weft threads befor repeat of the weaving pattern.

7. An improved forming fabric for paper-making, cellulose or similar machines, said fabric comprising two layers of synthetic weft threads and synthetic warp threads interconnecting said weft layers, the improvement comprising a first one of said layers of weft threads arranged to face the material to be formed during position of use of said fabric, said first layer as well as said warp threads interconnecting said weft layers being essentially tangents to the fabric plane intended to face said material said two layers of weft threads forming a pair to position said threads of each said pair essentially one on top of the other, each said warp thread binding in succession between a first pair of weft threads, over a second pair of weft threads, between a third pair of weft threads, over a fourth pair of weft threads, between a fifth pair of weft threads, over a sixth pair of weft threads, between a seventh pair of weft threads and beneath an eight pair and a ninth pair of weft threads before repeat of the weaving pattern.

8. An improved forming fabric for paper-making, cellulose or similar machines, said fabric comprising two layers of synthetic weft threads and synthetic warp threads interconnecting said weft layers, the improvement comprising a first one of said layers of weft threads arranged to face the material to be formed during position of use of said fabric, said first layer as well as said warp threads interconnecting said weft layers being essentially tangents to the fabric plane intended to face said material said two layers of weft threads forming a pair to position said threads of each said pair essentially one on top of the other, each said warp thread binding in succession between a first pair of weft threads, over a second pair of weft threads, between a third pair and a fourth pair of weft threads, over a fifth pair of weft threads, between a sixth pair of weft threads and beneath a seventh pair and an eighth pair of weft threads before repeat of the weaving pattern.

9. An improved forming fabric for paper-making, cellulose or similar machines, said fabric comprising two layers of synthetic weft threads and synthetic warp threads interconnecting said weft layers, the improvement comprising a first one of said layers of weft threads arranged to face the material to be formed during position of use of said fabric, said first layer as well as said warp threads interconnecting said weft layers being essentially tangents to the fabric plane intended to face said material said two layers of weft threads forming a pair to position said threads of each said pair essentially one on top of the other, each said warp thread binding in succession between a first pair of weft threads, over a second pair of weft threads, between a third pair of weft threads, over a fourth pair of weft threads, between a fifth pair of weft threads, over a sixth pair of weft threads, between a seventh pair of weft threads and beneath an eighth pair, a ninth pair and a tenth pair of weft threads before repeat of the weaving pattern.

10. An improved forming fabric for paper-making, cellulose or similar machines, said fabric comprising two layers of synthetic weft threads and synthetic warp threads interconnecting said weft layers, the improvement comprising a first one of said layers of weft threads arranged to face the material to be formed during position of use of said fabric, said first layer as well as said warp threads interconnecting said weft layers being essentially tangents to the fabric plane intended to face said material said two layers of weft threads forming a pair to position said threads of each said pair essentially one on top of the other, each said warp thread binding in succession between a first pair of weft threads, over a second pair of weft threads, between a third pair of weft threads, over a fourth pair of weft threads, between a fifth pair of weft threads and beneath a sixth pair, a seventh pair and an eighth pair of weft threads before repeat of the weaving pattern.

11. An improved forming fabric for paper-making, cellulose or similar machines, said fabric comprising two layers of synthetic weft threads and synthetic warp threads interconnecting said weft layers, the improvement comprising an upper one of said layers of weft threads arranged to face the material to be formed during position of use of said fabric, said upper layer as well as said warp threads interconnecting said weft layers being essentially tangents to the fabric plane intended to face said material, and each of said warp threads passing over at least one weft thread, under at least one following weft thread and over at least one thereon following weft thread of said upper weft layer before runing down to interconnect the lower weft layer with the upper weft layer, said two layers of weft thread being made to form a pair to position said threads of each said pair essentially one on top of the other, each said warp thread binding in sequence between a first pair of weft threads, over a second pair of weft threads, between a third pair of weft threads, above a fourth pair of weft threads, between a fifth pair of weft threads, and beneath a sixth pair and a seventh pair of weft threads before repeat of the weaving pattern.

12. An improved forming fabric for paper-making, cellulose or similar machines, said fabric comprising two layers of synthetic weft threads and synthetic warp threads interconnecting said weft layers, the improvement comprising an upper one of said layers of weft threads arranged to face the material to be formed during position of use of said fabric, said upper layer as well as said warp threads interconnecting said weft layers being essentially tagents to the fabric plane intended to face said material, and each of said warp threads passing over at least one weft thread, under at least one following weft thread and over at least one thereon following weft thread of said upper weft layer before running down to interconnect the lower weft layer with the upper weft layer, said two layers of weft threads forming a pair to position said threads of each said pair essentially one on top of the other, each said warp thread binding in succession between a first pair of weft threads, over a second pair of weft threads, between a third pair of weft threads, over a fourth pair of weft threads, between a fifth pair of weft threads, over a sixth pair of weft threads, between a seventh pair of weft threads and beneath an eighth pair and a ninth pair of weft threads before repeat of the weaving pattern.

13. An improved forming fabric for paper-making, cellulose or similar machines, said fabric comprising two layers of synthetic weft threads and synthetic warp threads interconnecting said weft layers, the improvement comprising an upper one of said layers of said layers of weft threads arranged to face the material to be formed during position of use of said fabric, said upper layer as well as said warp threads interconnecting said weft layers being essentially tangents to the fabric plane intended to face said material, and each of said warp threads passing over at least one weft thread, under at least one following weft thread and over at least one thereon following weft thread of said upper weft layer before running down to interconnect the lower weft layer with the upper weft layer, said two layers of weft threads forming a pair to position said threads of each said pair essentially one on top of the other, each said warp thread binding in succession between a first pair of weft threads, over a second pair of weft threads, between a third pair and a fourth pair of weft threads, over a fifth pair of weft threads, between a sixth pair of weft threads and beneath a seventh pair and an eighth pair of weft threads before repeat of the weaving pattern.

14. An improved forming fabric for paper-making, cellulose or similar machines, said fabric comprising two layers of synthetic weft threads and synthetic warp threads interconnecting said weft layers, the improvement comprising an upper one of said layers of weft threads arranged to face the material to be formed during position of use of said fabric, said upper layer as well as said warp threads interconnecting said weft layers being essentially tangents to the fabric plane intended to face said material, and each of said warp threads passing over at least one weft thread, under at least one following weft thread and over at least one thereon following weft thread of said upper weft layer before running down to interconnect the lower weft layer with the upper weft layer, said two layers of weft threads forming a pair to position said threads of each said pair essentially one on top of the other, each said warp thread binding in succession between a first pair of weft threads, over a second pair of weft threads, between a third pair of weft threads, over a fourth pair of weft threads, between a fifth pair of weft threads, over a sixth pair of weft threads, between a seventh pair of weft threads and beneath an eighth pair, a ninth pair and a tenth pair of weft threads before repeat of the weaving pattern.

15. An improved forming fabric for paper-making, cellulose or similar machines, said fabric comprising two layers of synthetic weft threads and synthetic warp threads interconnecting said weft layers, the improvement comprising an upper one of said layers of weft threads arranged to face the material to be formed during position of use of said fabric, said upper layer as well as said warp threads interconnecting said weft layers being essentially tangents to the fabric plane intended to face said material and each of said warp threads passing over at least one weft thread, under at least one following weft thread and over at least one thereon following weft thread of said upper weft layer before running down to interconnect the lower weft layer with the upper weft layer, said two layers of weft threads forming a pair to position said threads of each said pair essentially one on top of the other, each said warp thread binding in succession between a first pair of weft threads, over a second pair of weft threads, between a third pair of weft threads, over a fourth pair of weft threads, between a fifth pair of weft threads and beneath a sixth pair, a seventh pair and an eighth pair of weft threads before repeat of the weaving pattern.

* * * * *